US009805849B2

(12) United States Patent
Yuan

(10) Patent No.: US 9,805,849 B2
(45) Date of Patent: Oct. 31, 2017

(54) RESISTOR CIRCUIT WITH TEMPERATURE COEFFICIENT COMPENSATION

(71) Applicant: Zhiyong Yuan, Shanghai (CN)

(72) Inventor: Zhiyong Yuan, Shanghai (CN)

(73) Assignee: Shanghai Huahong Grace Semiconductor Manufacturing Corporation, Shanghai (CN)

( * ) Notice: Subject to any disclaimer, the term of this patent is extended or adjusted under 35 U.S.C. 154(b) by 0 days.

(21) Appl. No.: 14/735,294

(22) Filed: Jun. 10, 2015

(65) Prior Publication Data

US 2016/0155547 A1 Jun. 2, 2016

(30) Foreign Application Priority Data

Nov. 28, 2014 (CN) ..... 2014 1 0712224

(51) Int. Cl.

| | |
|---|---|
| ***H01C 13/02*** | (2006.01) |
| ***H01C 7/06*** | (2006.01) |
| ***H01C 7/02*** | (2006.01) |
| ***H01C 7/04*** | (2006.01) |

(52) U.S. Cl.

CPC ..... *H01C 13/02* (2013.01); *H01C 7/02* (2013.01); *H01C 7/04* (2013.01); *H01C 7/06* (2013.01)

(58) Field of Classification Search

CPC ..... H01C 13/02

See application file for complete search history.

(56) References Cited

U.S. PATENT DOCUMENTS

| | | | | |
|---|---|---|---|---|
| 2008/0218248 | A1* | 9/2008 | Kim | H01C 13/02 327/525 |
| 2011/0260826 | A1* | 10/2011 | Belman | H01C 1/16 338/325 |
| 2016/0155547 | A1* | 6/2016 | Yuan | H01C 7/06 338/9 |

* cited by examiner

*Primary Examiner* — James Harvey

(74) *Attorney, Agent, or Firm* — MKG, LLC

(57) ABSTRACT

The present invention discloses a resistor circuit with temperature coefficient compensation, which comprises a first series resistor composed of a first resistor and a second resistor interconnected in series, and a second parallel resistor composed of a third resistor and a fourth resistor interconnected in series, with the first series resistor and the second parallel resistor interconnected in series, wherein the first resistor and the second resistor respectively have a positive and negative temperature coefficient and make the positive and negative temperature coefficients of the first series resistor offset each other, and the third resistor and the fourth resistor respectively have a positive and negative temperature coefficient and make the positive and negative temperature coefficients of the second parallel resistor offset each other.

10 Claims, 3 Drawing Sheets

RESISTOR CIRCUIT WITH TEMPERATURE COEFFICIENT COMPENSATION

This application claims a foreign priority of Chinese Patent Application No. 201410712224.5 filed on Nov. 28, 2014, which foreign priority of Chinese Patent Application, in its entirety, is incorporated herein by reference.

FIELD OF THE INVENTION

The present invention relates to a semiconductor integrated circuit, especially to a resistor circuit with temperature coefficient compensation.

BACKGROUND OF THE INVENTION

In many system-on-chip (SOC) applications, an oscillator is a very important module. The oscillators are classified into resistance-capacitance oscillators—i.e. RC oscillators, inductance-capacitance oscillators—i.e. LC oscillators, crystal oscillators, tuning fork oscillators, and the like. The RC oscillator outputs an oscillation signal through charging and discharging the capacitor, and it can adjust the frequency of the oscillation signal by adjusting the resistance or capacitance. With respect to other types of oscillators, the RC oscillator has the advantages of simple structure and high precision. Therefore, the on-chip RC oscillator (RC silicon oscillator) is widely used in charge pump (PUMP) driving, a logic (LOGIC) clock, and other applications in a smart card, an Micro Control Unit (MCU) and other products.

The temperature coefficient of frequency of the RC oscillator is determined by the temperature coefficient of the product RC, wherein the temperature coefficient of R, i.e. the resistance itself, is the main factor. The resistor after the temperature coefficient compensation provides the possibility for the realization of the project of the high-precision RC oscillator. In the prior art, the resistor circuit with temperature coefficient compensation is achieved mainly by interconnecting in series the resistors having a positive or negative temperature coefficient, or by interconnecting in parallel the resistors having a positive or negative temperature coefficient. As shown in FIG. 1, there is a resistor circuit with temperature coefficient compensation. In FIG. 1, a series resistor R101 is formed by interconnecting in series a resistor Rp101 having a positive temperature coefficient and a resistor Rn101 having a negative temperature coefficient, with the temperature coefficient of the entire series resistor R101 reduced or eliminated by mutually offsetting and compensating the positive and negative temperature coefficients of the resistors Rp101 and Rn101. In the application of the on-chip RC oscillator, with the two series resistors Rp101 and Rn101 having the on-chip structure, different types of resistors are needed for the on-chip resistor to achieve a resistor having a different temperature coefficient; for example, a polysilicon resistor, a diffusion resistor or an N-well resistor can achieve a positive temperature coefficient; and a polysilicon resistor can achieve a negative temperature coefficient. The positive or negative temperature coefficient of the polysilicon resistor can vary with different doping concentration thereof. In semiconductor manufacturing, the resistance value may changes about ±20% under different process variations, i.e. process corner. For example, the resistance value will be smaller under faster process and larger under slower process. The change directions of different types of resistors may be different. Thus, the resistance values of different types of resistors many become larger or smaller. Due to the different types of resistors Rp101 and Rn101 connected in series, one of the resistance values of the two resistors may become larger while the other one of the resistance values may become smaller. The structure as shown in FIG. 1 will not play a role of temperature compensation unless the resistance values of the two resistors become larger or smaller at the same time. If one of the resistance values becomes larger while the other one of the resistance values becomes smaller, the structure as shown in FIG. 1 has no compensating effects and even deteriorates the compensating effect.

Similar to the resistor circuit with temperature coefficient compensation formed in series, because the process corners of the two resistors are not necessarily changed in the same direction in the case that the two parallel resistors are different in types, the resistor circuit with temperature coefficient compensation formed in parallel has no compensating effects and even deteriorating the compensating effect in the case of opposite corner changes.

CONTENTS OF THE INVENTION

The technical problem to be solved by the present invention is to provide a resistor circuit with temperature coefficient compensation, which can keep the temperature coefficient compensation function in any combination of process corner variations and achieve the high-precision resistance at any process corners.

In order to solve the above technical problem, the resistor circuit with temperature coefficient compensation provided by the present invention comprises a first series resistor composed of a first resistor and a second resistor interconnected in series, and a second parallel resistor composed of a third resistor and a fourth resistor interconnected in series, with the first series resistor and the second parallel resistor interconnected in series.

The first resistor has a first positive temperature coefficient, and the second resistor has a first negative temperature coefficient, with the first resistor, the second resistor, the first positive temperature coefficient and the first negative temperature coefficient set to make the positive and negative temperature coefficients of the first series resistor offset each other.

The third resistor has a second positive temperature coefficient, and the fourth resistor has a second negative temperature coefficient, with the third resistor, the fourth resistor, the second positive temperature coefficient and the second negative temperature coefficient set to make the positive and negative temperature coefficients of the second parallel resistor offset each other.

Preferably, the first positive temperature coefficient, the first negative temperature coefficient, the second positive temperature coefficient, and the second negative temperature coefficient are all first-order coefficients.

Preferably, the absolute value of the product of the first positive temperature coefficient and the constant term of the first resistor is equal to the absolute value of the product of the first negative temperature coefficient and the constant term of the second resistor.

Preferably, the absolute value of the first positive temperature coefficient is equal to that of the first negative temperature coefficient, and the constant term of the first resistor is equal to that of the second resistor.

Preferably, the absolute value of the second positive temperature coefficient is equal to that of the second negative temperature coefficient, and the constant term of the third resistor is equal to that of the fourth resistor.

Preferably, the absolute value of the second positive temperature coefficient is unequal to that of the second negative temperature coefficient; the constant terms of the third resistor and the fourth resistor are set according to the second positive temperature coefficient and the second negative temperature coefficient, and the first-order temperature coefficient of the second parallel resistor is set to be zero.

Preferably, the first positive temperature coefficient is equal to the second positive temperature coefficient, and the first negative temperature coefficient is equal to the second negative temperature coefficient.

Preferably, the first resistor, the second resistor, the third resistor and the fourth resistor are formed with the CMOS process and integrated on one and the same silicon chip.

Preferably, the first resistor is a polysilicon resistor, a diffusion resistor or an N-well resistor in the CMOS process; the third resistor is a polysilicon resistor, a diffusion resistor or an N-well resistor in the CMOS process; the second resistor is a polysilicon resistor; and the fourth resistor is a polysilicon resistor.

The present invention, by interconnecting in series the first series resistor and the second parallel resistor respectively having temperature coefficient compensation, can provide the secondary the temperature coefficient compensation function between the first series resistor and the second parallel resistor; that is, when the process corners of the resistors having a positive and negative temperature coefficient are changed oppositely in direction, the temperature coefficient of the second parallel resistor will deteriorate in the other direction while the temperature coefficient of the first series resistor deteriorates in one direction, with both just achieving compensation, thereby able to keep the temperature coefficient compensation function in any combination of process corner variations and achieve the high-precision resistance at any process corners.

BRIEF DESCRIPTION OF THE DRAWINGS

The present invention will be further described below in detail with reference to drawings and specific embodiments.

DETAILED DESCRIPTION OF THE EMBODIMENTS

Figure 2:
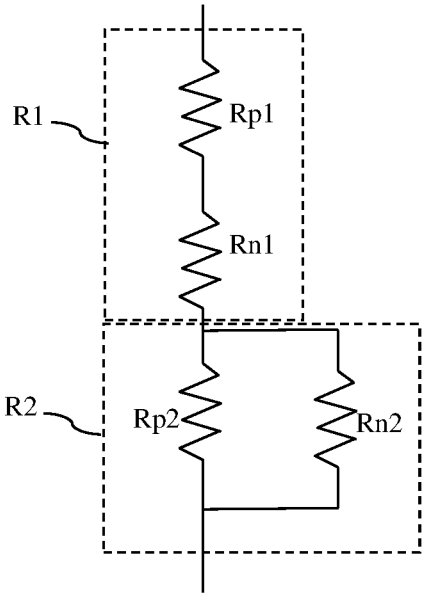
FIG. 2 shows a resistor circuit with temperature coefficient compensation of the example of the present invention.

As shown in FIG. 2, there is a resistor circuit with temperature coefficient compensation of the example of the present invention. The resistor circuit with temperature coefficient compensation of the example of the present invention comprises a first series resistor R1 composed of a first resistor Rp1 and a second resistor Rn1 interconnected in series, and a second parallel resistor R2 composed of a third resistor Rp2 and a fourth resistor Rn2 interconnected in series, with the first series resistor R1 and the second parallel resistor R2 interconnected in series.

The first resistor Rp1 has a first positive temperature coefficient, and the second resistor Rn1 has a first negative temperature coefficient, with the first resistor Rp1, the second resistor Rn1, the first positive temperature coefficient and the first negative temperature coefficient set to make the positive and negative temperature coefficients of the first series resistor R1 offset each other.

The third resistor Rp2 has a second positive temperature coefficient, and the fourth resistor Rn2 has a second negative temperature coefficient, with the third resistor Rp2, the fourth resistor Rn2, the second positive temperature coefficient and the second negative temperature coefficient set to make the positive and negative temperature coefficients of the second parallel resistor R2 offset each other.

The temperature coefficient of the resistor can include a first-order coefficient, a second-order coefficient and so on; when considering a multiple-order coefficient, there is the following Formula (I):

$$R=R_0\times(1+\alpha_1\times T+\alpha_2\times T^2+\ldots) \tag{1}$$

In Formula (I), R represents resistance having a temperature coefficient, R0 represents a constant term of the resistance, T represents the difference between the actual temperature and the ambient temperature (with the ambient temperature in the example of the present invention being 25° C.), $\alpha_1$ represents a first-order coefficient, and $\alpha_2$ represents a second-order coefficient. A higher-order coefficient than $\alpha_2$ can be generally ignored. Therefore, it is preferred that the first positive temperature coefficient, the first negative temperature coefficient, the second positive temperature coefficient, and the second negative temperature coefficient are all a first-order coefficient.

The temperature coefficient of the first series resistor R1 can be deduced as follows:

$$R1=Rp1+Rn1=Rp1_0\times(1+\alpha_{11}\times T)+Rn1_0\times(1+\alpha_{12}\times T)=Rp1_0+Rn1_0+(Rp1_0\times\alpha_{11}+Rn1_0\times\alpha_{12})T \tag{2}$$

In Formula (2), R1 represents the value of the first series resistor R1, Rp1 represents the value of the first resistor Rp1, Rn1 represents the value of the second resistor Rn1, $Rp1_0$ represents the constant term of Rp1, $Rn1_0$ represents the constant term of Rn1, $\alpha_{11}$ represents the first positive temperature coefficient, and $\alpha_{12}$ represents the first negative temperature coefficient. It can be known that, in order to make R1 irrelevant to the temperature, the coefficient $(Rp1_0\times\alpha_{11}+Rn1_0\times\alpha_{12})$ needs to be set as zero, that is, the absolute value of the product of the first positive temperature coefficient $\alpha_{11}$ and the constant term of the first resistor Rp1 is equal to the absolute value of the product of the first negative temperature coefficient $\alpha_{12}$ and the constant term of the second resistor Rn1. In a preferred example, the absolute value of the first positive temperature coefficient is set to be equal to that of the first negative temperature coefficient, and the constant term of the first resistor Rp1 is also set to be equal to that of the second resistor Rn1.

The temperature coefficient of the second series resistor R2 can be deduced as follows:

$$R2=\frac{Rp2\times Rn2}{Rp2+Rn2}=\frac{Rp2_0\times Rn2_0[1+\alpha_{13}+\alpha_{14})T+(\alpha_{13}\times\alpha_{14})T^2]}{Rp2_0+Rn2_0+(Rp2_0\times\alpha_{13}+Rn2_0\times\alpha_{14})T} \tag{3}$$

Performing the Taylor expansion on Formula (3) and omitting the second-order term to get the following equation:

$$R2 = \frac{Rp2_0 \times Rn2_0}{Rp2_0 + Rn2_0} \times \left\{1 + \left[\alpha_{13} + \alpha_{14} - \frac{Rp2_0 \times \alpha_{13} + Rn2_0 \times \alpha_{14}}{Rp2_0 + Rn2_0}\right] \times T\right\} \quad (4)$$

R2 in Formulas (3) and (4) represents the value of the second parallel resistor R2, Rp2 represents the value of the third resistor Rp2, Rn2 represents the value of the fourth resistor Rn2, $Rp2_0$ represents the constant term of Rp2, $Rn2_0$ represents the constant term of Rn2, $\alpha_{13}$ represents the second positive temperature coefficient, and $\alpha_{14}$ represents the second negative temperature coefficient. It can be known that, in order to make R2 irrelevant to temperature, the coefficient $$\left[\alpha_{13} + \alpha_{14} - \frac{Rp2_0 \times \alpha_{13} + Rn2_0 \times \alpha_{14}}{Rp2_0 + Rn2_0}\right]$$

needs to be set as zero. When the absolute value of the second positive temperature coefficient $\alpha_{13}$ is set to be equal to that of the second negative temperature coefficient $\alpha_{14}$, the constant term of the third resistor Rp2 is also set to be equal to that of the fourth resistor Rn2. When the absolute value of the second positive temperature coefficient $\alpha_{13}$ is set to be unequal to that of the second negative temperature coefficient $\alpha_{14}$, the constant terms of the third resistor Rp2 and the fourth resistor Rn2 are such set as to meet the above Formula (4), thus making the first-order temperature coefficient of the second parallel resistor R2 be zero.

In a preferred example, the first positive temperature coefficient is equal to the second positive temperature coefficient, and the first negative temperature coefficient is equal to the second negative temperature coefficient.

In the example of the present invention, the first resistor Rp1, the second resistor Rn1, the third resistor Rp2 and the fourth resistor Rn1 are formed with the CMOS process and integrated on one and the same silicon chip. The first resistor Rp1 is a polysilicon resistor, a diffusion resistor or an N-well resistor in the CMOS process; the third resistor Rp2 is a polysilicon resistor, a diffusion resistor or an N-well resistor in the CMOS process; the second resistor Rn1 is a polysilicon resistor; and the fourth resistor Rn2 is a polysilicon resistor. Thus, the resistor circuit with temperature coefficient compensation of the example of the present invention can be used in the on-chip RC oscillator.

Figure 3A:
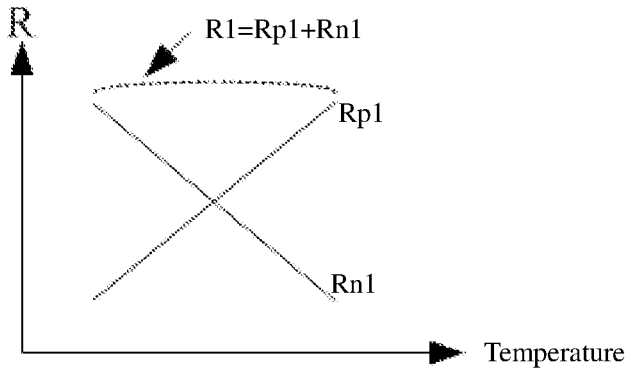
FIG. 3A shows a curve of the series resistor in FIG. 2 varying with the temperature.
Figure 3B:
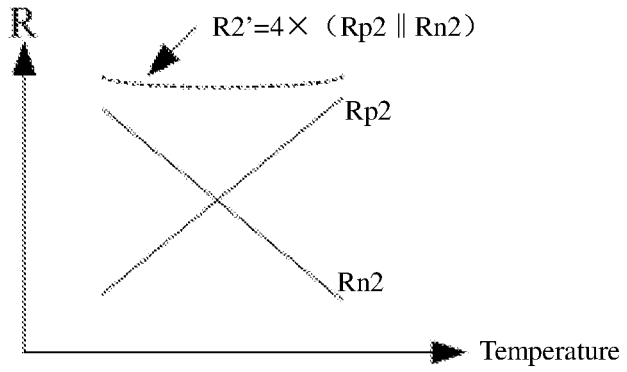
FIG. 3B shows a curve of the parallel resistor in FIG. 2 varying with the temperature.
Figure 3C:
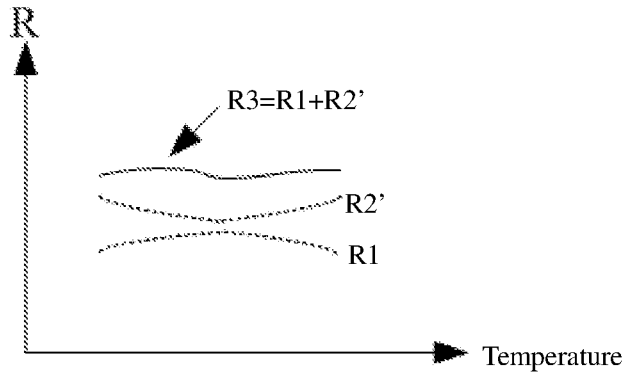
FIG. 3C shows a curve of a total resistor varying with the temperature, with the total resistor composed of the resistors in FIG. 2 interconnected in series and parallel.

As shown in FIG. 3A, there is a curve of the series resistor R1 in FIG. 2 varying with the temperature. As shown in FIG. 3B, there is a curve of the parallel resistor in FIG. 2 varying with the temperature, and specifically a curve of four times the value of the parallel resistor R2, i.e. R2', varying with the temperature. As shown in FIG. 3C, there is a curve of a total resistor R3 varying with the temperature, with the total resistor R3 composed of the resistors in FIG. 2 interconnected in series and parallel. The example of the present invention, by interconnecting in series the first series resistor R1 and the second parallel resistor R2 having temperature coefficient compensation, respectively, can provide the secondary temperature coefficient compensation function between the first series resistor R1 and the second parallel resistor R2 of the present invention; that is, when the process corners of the resistors having a positive and negative temperature coefficient are changed oppositely in direction, the temperature coefficient of the second parallel resistor R2 will deteriorate in the other direction while the temperature coefficient of the first series resistor R1 deteriorates in one direction, with both just achieving compensation, thereby able to keep the temperature coefficient compensation function in any combination of process corner variations and achieve the high-precision resistance at any process corners.

Figure 1:
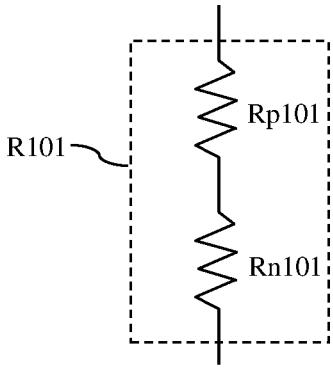
(Prior Art) Fig 1
FIG. 1 shows an existing resistor circuit with temperature coefficient compensation.
Figure 4A:
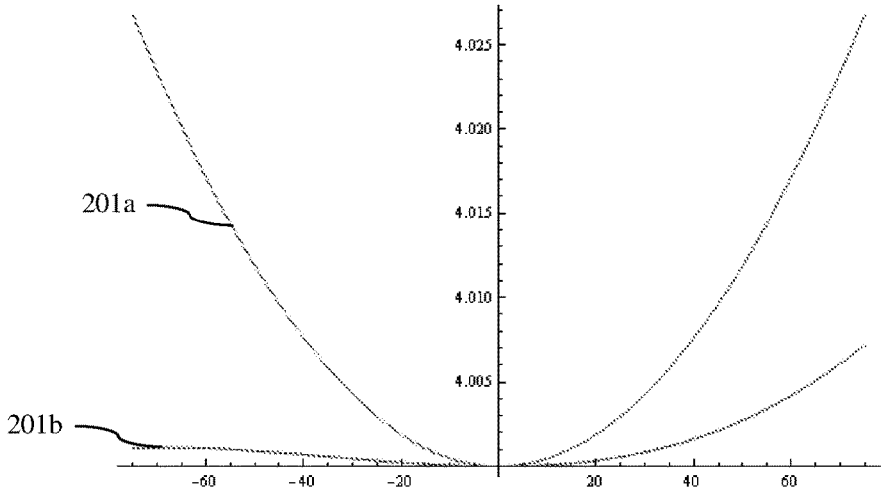
FIG. 4A is a test curve of the resistor circuit of the example of the present invention and the existing resistor circuit at the first process corner.
Figure 4B:
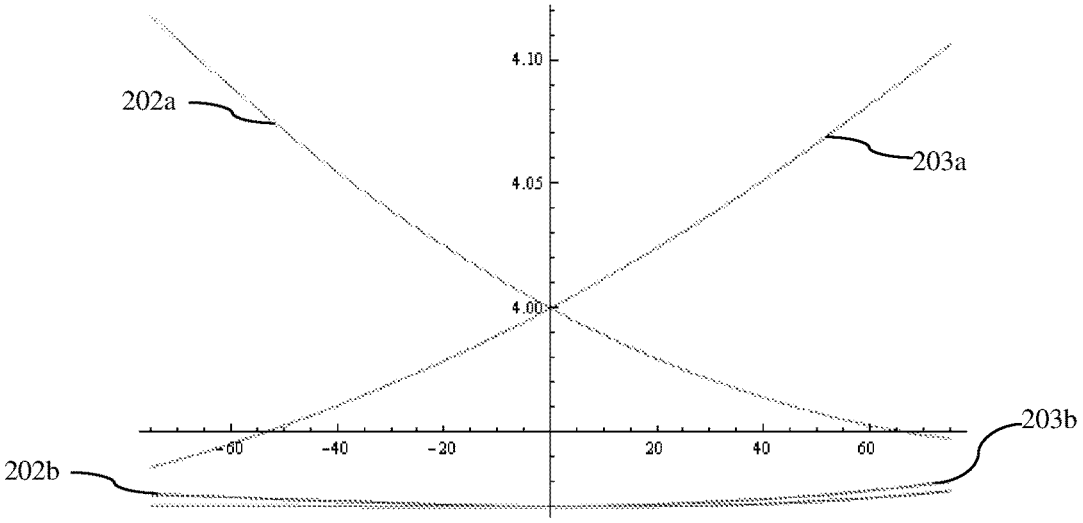
FIG. 4B is a test curve of the resistor circuit of the example of the present invention and the existing resistor circuit at the second and third process corners.

As shown in FIG. 4A, there is a test curve of the resistor circuit of the example of the present invention and an existing resistor circuit at the first process corner, wherein the abscissa of the curve is T, i.e. the difference between the actual temperature and the ambient temperature, and the ordinate is unit resistance (Unite res.). As shown in FIG. 4B, there are test curves of the resistor circuit of the example of the present invention and an existing resistor circuit at the second and third process corners. Both of the first resistor Rp1 and the third resistor Rp2 of the resistor circuit tested in FIGS. 4A and 4B are of the p-type diffusion resistor B with a positive temperature coefficient in the CMOS process, and both of the second resistor Rn1 and the fourth resistor Rn2 are of the n-type polysilicon resistor A with a negative temperature coefficient in the CMOS process. To have a comparison, the resistor Rp101 of the existing resistor circuit shown in FIG. 1 is of the p-type diffusion resistor B with a positive temperature coefficient in the CMOS process, and the resistor Rn101 is of the n-type polysilicon resistor A with a negative temperature coefficient in the CMOS process. The first process corner is TypA&B, the second process corner is MAX A and MIN B, and the third process corner is MIN A and MAX B. The curve 201*a* is a test curve of the existing resistor circuit at the first process corner, the curve 201*b* is a test curve of the resistor circuit of the example of the present invention at the first process corner, the curve 202*a* is a test curve of the existing resistor circuit at the second process corner, the curve 202*b* is a test curve of the resistor circuit of the example of the present invention at the second process corner, the curve 203*a* is a test curve of the existing resistor circuit at the third process corner, and the curve 203*b* is a test curve of the resistor circuit of the example of the present invention at the third process corner. It can be known from the above comparison that the resistor of the example of the present invention can really make the resistor circuit keep the temperature coefficient compensation function in any combination of process corner variations, and achieve the high-precision resistance at any process corners. Besides, as shown in Table I, there are measurement values of the resistor circuit of the example of the present invention and an existing resistor circuit at the third process corner, respectively, with the measurement values in Table I obtained by dividing the difference between the greatest value and the minimum value of the unit resistance by the minimum value.

TABLE I

| Process corner | Measurement value of the resistor circuit of the example of the present invention (MAX/MIN − 1%) | Measurement value of the existing resistor circuit (MAX/MIN − 1%) | Multiples increased |
|---|---|---|---|
| TypA&B | 0.125% | 0.625% | about 5 |
| MAX A, MIN B | 0.15% | 4.35% | about 29 |

TABLE I-continued

| Process corner | Measurement value of the resistor circuit of the example of the present invention (MAX/MIN − 1%) | Measurement value of the existing resistor circuit (MAX/MIN − 1%) | Multiples increased |
|---|---|---|---|
| MIN A, MAX B | 0.255% | 4.35% | about 17 |

The present invention has been described in detail above through specific examples, which do not restrict the present invention. However, without departing from the principle of the present invention, those skilled in the art can also make a lot of deformation and improvement, which should be also regarded as within the scope of protection of the present invention.

The invention claimed is:

1. A resistor circuit with temperature coefficient compensation, comprising a first resistor array and a second resistor array connected in series;

wherein the first resistor array is composed of a first resistor and a second resistor interconnected in series, and the second resistor array is composed of a third resistor and a fourth resistor interconnected in parallel;

wherein the first resistor and the third resistor have positive temperature coefficient, and the second resistor and the fourth resistor have negative temperature coefficient, wherein the first resistor array forms a first-order temperature compensation by the first resistor and the second resistor in series connection; the second resistor array forms a first-order temperature compensation by the third resistor and the fourth resistor connected in parallel;

wherein the first resistor array and the second array interconnected in series form a second-order temperature compensation.

2. The resistor circuit with temperature coefficient compensation according to claim 1, wherein the first positive temperature coefficient, the first negative temperature coefficient, the second positive temperature coefficient, and the second negative temperature coefficient are all first-order coefficients.

3. The resistor circuit with temperature coefficient compensation according to claim 2, wherein an absolute value of a product of the first positive temperature coefficient and a constant term of the first resistor is equal to an absolute value of a product of the first negative temperature coefficient and a constant term of the second resistor.

4. The resistor circuit with temperature coefficient compensation according to claim 3, wherein the absolute value of the first positive temperature coefficient is equal to that of the first negative temperature coefficient, and the constant term of the first resistor is equal to that of the second resistor.

5. The resistor circuit with temperature coefficient compensation according to claim 2, wherein the absolute value of the second positive temperature coefficient is equal to that of the second negative temperature coefficient, and the constant term of the third resistor is equal to that of the fourth resistor.

6. The resistor circuit with temperature coefficient compensation according to claim 2, wherein the absolute value of the second positive temperature coefficient is unequal to that of the second negative temperature coefficient; the constant terms of the third resistor and the fourth resistor are set according to the second positive temperature coefficient and the second negative temperature coefficient, and a first-order temperature coefficient of the second parallel resistor is set to be zero.

7. The resistor circuit with temperature coefficient compensation according to claim 2, wherein the first positive temperature coefficient is equal to the second positive temperature coefficient, and the first negative temperature coefficient is equal to the second negative temperature coefficient.

8. The resistor circuit with temperature coefficient compensation of claim 1, wherein the first resistor, the second resistor, the third resistor and the fourth resistor are formed with the CMOS process and integrated on one and the same silicon chip.

9. The resistor circuit with temperature coefficient compensation according to claim 8, wherein the first resistor is a polysilicon resistor, a diffusion resistor or an N-well resistor in the CMOS process; the third resistor is a polysilicon resistor, a diffusion resistor or an N-well resistor in the CMOS process; the second resistor is a polysilicon resistor; and the fourth resistor is a polysilicon resistor.

10. A resistor circuit with temperature coefficient compensation, comprising a first series resistor composed of a first resistor and a second resistor interconnected in series, and a second parallel resistor composed of a third resistor and a fourth resistor interconnected in series, with the first series resistor and the second parallel resistor interconnected in series;

the first resistor has a first positive temperature coefficient, and the second resistor has a first negative temperature coefficient, with the first resistor, the second resistor, the first positive temperature coefficient and the first negative temperature coefficient set to make the positive and negative temperature coefficients of the first series resistor offset each other; and the third resistor has a second positive temperature coefficient, and the fourth resistor has a second negative temperature coefficient, with the third resistor, the fourth resistor, the second positive temperature coefficient and the second negative temperature coefficient set to make the positive and negative temperature coefficients of the second parallel resistor offset each other.

* * * * *